US010220633B2

(12) United States Patent
Matsuyama

(10) Patent No.: US 10,220,633 B2
(45) Date of Patent: Mar. 5, 2019

(54) VALVE UNIT, PRINTING APPARATUS, AND PRINTING METHOD

(71) Applicant: SEIKO EPSON CORPORATION, Tokyo (JP)

(72) Inventor: Ryotaro Matsuyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/630,507

(22) Filed: Jun. 22, 2017

(65) Prior Publication Data

US 2018/0001655 A1 Jan. 4, 2018

(30) Foreign Application Priority Data

Jun. 30, 2016 (JP) ..... 2016-129609

(51) Int. Cl.
*B41J 2/17* (2006.01)
*B41J 2/175* (2006.01)
*B41J 2/195* (2006.01)

(52) U.S. Cl.
CPC ..... *B41J 2/17596* (2013.01); *B41J 2/175* (2013.01); *B41J 2/1707* (2013.01); *B41J 2/195* (2013.01)

(58) Field of Classification Search
CPC ..... B41J 2/17596; B41J 2/175; B41J 2/195
See application file for complete search history.

(56) References Cited

U.S. PATENT DOCUMENTS 7,845,776 B2 12/2010 Kachi
8,033,635 B2 10/2011 Silverbrook
8,511,809 B2 8/2013 Yunoki
2015/0029274 A1* 1/2015 Shimizu ..... B41J 2/17596 347/86

FOREIGN PATENT DOCUMENTS

JP 2011-000831 A 1/2011

OTHER PUBLICATIONS

European Search Report for Application No. 17178571 dated Nov. 14, 2017.

* cited by examiner

*Primary Examiner* — Sharon A Polk
(74) *Attorney, Agent, or Firm* — Workman Nydegger

(57) ABSTRACT

Provided are a valve unit, a printing apparatus, and a printing method capable of preventing sediment arising in the valve unit from flowing toward a discharge unit.
The valve unit is used in a printing apparatus including a reservoir unit that holds ink, a discharge unit configured to discharge the ink, and a flow channel that connects the reservoir unit to the discharge unit and through which the ink flows from the reservoir unit to the discharge unit. The valve unit is disposed partway along the flow channel, and includes: a first chamber that configured to communicate with the reservoir unit; a second chamber configured to communicate with the discharge unit; a switching valve that switches between allowing and cutting off a flow of ink from the first chamber to the second chamber; and an expelling unit configured to expel sediment from the second chamber by suctioning the sediment.

20 Claims, 11 Drawing Sheets

VALVE UNIT, PRINTING APPARATUS, AND PRINTING METHOD

BACKGROUND

1. Technical Field

The present invention relates to a valve unit, a printing apparatus, and a printing method.

Printing apparatuses that print onto a roll-shaped recording medium using an ink jet technique are known (see JP-A-2011-831, for example). Such a printing apparatus includes an ink cartridge filled with ink, a recording head that forms an image by discharging the ink, and a tube, connecting the ink cartridge and the recording head, through which the ink passes.

In recent years, there have seen an increasing trend toward deeper colors in ink. Thus, such inks contain a comparatively high percentage of low-solubility components. Depending on conditions, such low-solubility components may form deposits and crystallize along the path from the ink cartridge to the recording head, and such crystallized deposits act as foreign substances. These foreign substances can cause clogging, discharge defects, and the like in the recording head. It is thus desirable that foreign substances be removed on the upstream side of the recording head to the greatest extent possible.

SUMMARY

A valve unit according to an aspect of the invention is a valve unit used in a printing apparatus including a reservoir unit that holds ink, a discharge unit configured to discharge the ink, and a flow channel that connects the reservoir unit to the discharge unit and through which the ink flows from the reservoir unit to the discharge unit. The valve unit is disposed partway along the flow channel, and includes: a first chamber configured to communicate with the reservoir unit; a second chamber configured to communicate with the discharge unit; a switching valve configured to switch between allowing and cutting off a flow of ink from the first chamber to the second chamber; and an expelling unit configured to expel sediment from the second chamber by suctioning the sediment.

Accordingly, even if sediment is formed in the second chamber of the valve unit, that sediment can be expelled through the expelling unit. Doing so makes it possible to prevent the sediment from flowing out toward the discharge unit. This in turn makes it possible to prevent clogging, discharge defects, and the like from occurring in the discharge unit.

It is preferable that the valve unit be used in an orientation in which the expelling unit is positioned below the second chamber.

The sediment settles downward in the second chamber, and thus positioning the expelling unit below the second chamber ensures that the sediment is quickly expelled from the expelling unit.

It is preferable that the second chamber have a part in which a horizontal cross-sectional area decreases toward the expelling unit side.

This ensures that the sediment gathers toward the expelling unit. This in turn makes it easy to expel the sediment from the expelling unit.

A printing apparatus according to an aspect of the invention is a printing apparatus including a reservoir unit that holds ink, a discharge unit configured to discharge the ink, a flow channel that connects the reservoir unit to the discharge unit and through which the ink flows from the reservoir unit to the discharge unit, and a valve unit disposed partway along the flow channel. The valve unit includes: a first chamber configured to communicate with the reservoir unit; a second chamber configured to communicate with the discharge unit; a switching valve configured to switch between allowing and cutting off a flow of ink from the first chamber to the second chamber; and an expelling unit configured to expel sediment from the second chamber by suctioning the sediment.

Accordingly, even if sediment is formed in the second chamber of the valve unit, that sediment can be expelled through the expelling unit. Doing so makes it possible to prevent the sediment from flowing out toward the discharge unit. This in turn makes it possible to prevent clogging, discharge defects, and the like from occurring in the discharge unit.

It is preferable that the expelling of the sediment from the expelling unit be carried out when the discharge of ink from the discharge unit stops and printing ends.

Accordingly, a situation where the expelling of sediment affects the amount of ink discharged during printing, the pressure at which the ink is supplied to the discharge unit, and the like can be prevented.

It is preferable that the expelling of the sediment from the expelling unit be carried out along with flushing that makes a trial discharge of the ink from the discharge unit, or after the flushing but before printing starts.

Accordingly, a situation where the expelling of sediment affects the amount of ink discharged during printing, the pressure at which the ink is supplied to the discharge unit, and the like can be prevented.

It is preferable that the printing apparatus be capable of color printing, and that the discharge unit include a nozzle row having a plurality of nozzles that discharge the ink of a same color as droplets.

Accordingly, a medium on which color printing has been carried out has an extremely fine, or in other words, a precise image.

It is preferable that one of the valve units be disposed for a single one of the nozzle rows.

Accordingly, the ink can be stably discharged as droplets from the nozzles belonging to a single nozzle row.

It is preferable that the discharge unit have a plurality of the nozzle rows, and that the printing apparatus further include a merging portion into which the sediment expelled through the expelling unit of each valve unit merges.

Accordingly, sediment that has merged at the merging portion can be suctioned and expelled all at once, and thus the operation of expelling the sediments can be carried out quickly and easily.

It is preferable that the printing apparatus further include: a connecting portion, provided downstream from the merging portion, to which a suction device that suctions the sediment expelled through the expelling unit is connected; and an opening/closing valve, provided between the merging portion and the connecting portion, configured to open when the suction device suctions the sediment and close when the suctioning of the sediment is stopped.

Accordingly, even if the suction device is separated from the connecting portion, for example, closing the opening/closing valve makes it possible to prevent bubbles from entering into the valve unit from the exterior.

It is preferable that an amount of the sediment expelled through the expelling unit be less than an amount of the ink supplied from the second chamber to the discharge unit.

Although ink is expelled from the expelling unit along with the sediment, the amount of ink expelled can be suppressed to the greatest extent possible. This makes it possible to prevent the ink from being wastefully expelled.

It is preferable that the printing apparatus further include a notifying unit configured to make a notification prompting the sediment to be expelled.

This makes it possible to ensure that an operator or the like does not forget to carry out the operation for expelling the sediment.

A printing method according to an aspect of the invention includes: printing onto a recording medium using a printing apparatus, the printing apparatus including a reservoir unit that holds ink, a discharge unit configured to discharge the ink, a flow channel that connects the reservoir unit to the discharge unit and through which the ink flows from the reservoir unit to the discharge unit, and a valve unit disposed partway along the flow channel, and the valve unit including a first chamber configured to communicate with the reservoir unit, a second chamber configured to communicate with the discharge unit, a switching valve that switches between allowing and cutting off a flow of ink from the first chamber to the second chamber, and an expelling unit configured to expel sediment from the second chamber by suctioning the sediment; and expelling the sediment from the expelling unit while the printing is stopped.

Accordingly, even if sediment is formed in the second chamber of the valve unit, that sediment can be expelled through the expelling unit. Doing so makes it possible to prevent the sediment from flowing out toward the discharge unit. This in turn makes it possible to prevent clogging, discharge defects, and the like from occurring in the discharge unit.

BRIEF DESCRIPTION OF THE DRAWINGS

The invention will be described with reference to the accompanying drawings, wherein like numbers reference like elements.

DESCRIPTION OF EMBODIMENTS

A valve unit, a printing apparatus, and a printing method according to the invention will be described in detail hereinafter on the basis of preferred exemplary embodiments, which are illustrated in the appended drawings.

First Exemplary Embodiment

Figure 1:
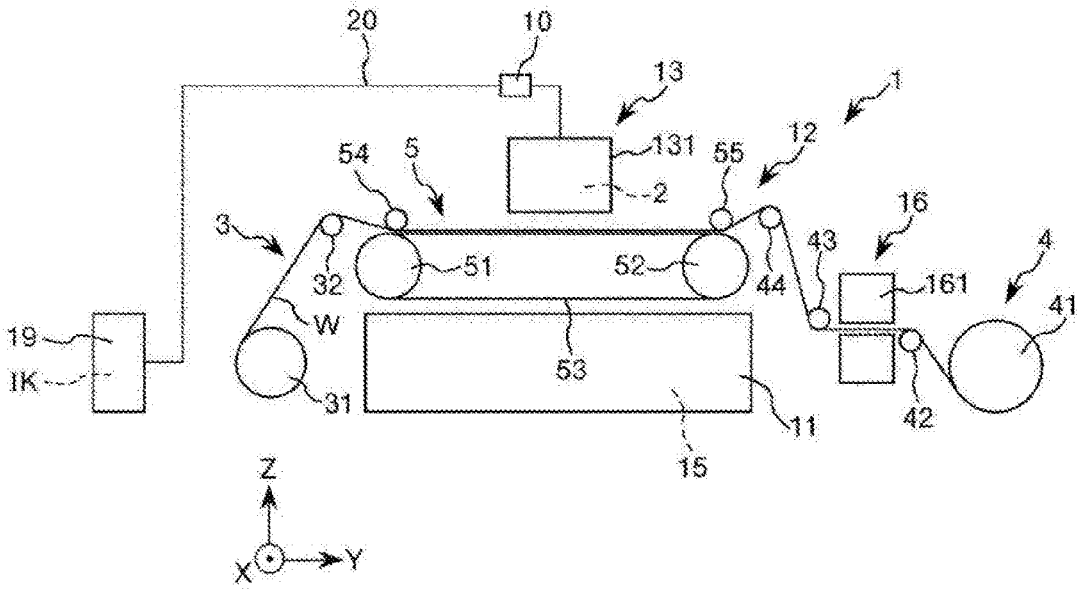
FIG. 1 is a schematic side view illustrating a first exemplary embodiment of a printing apparatus according to the invention.
Figure 2:
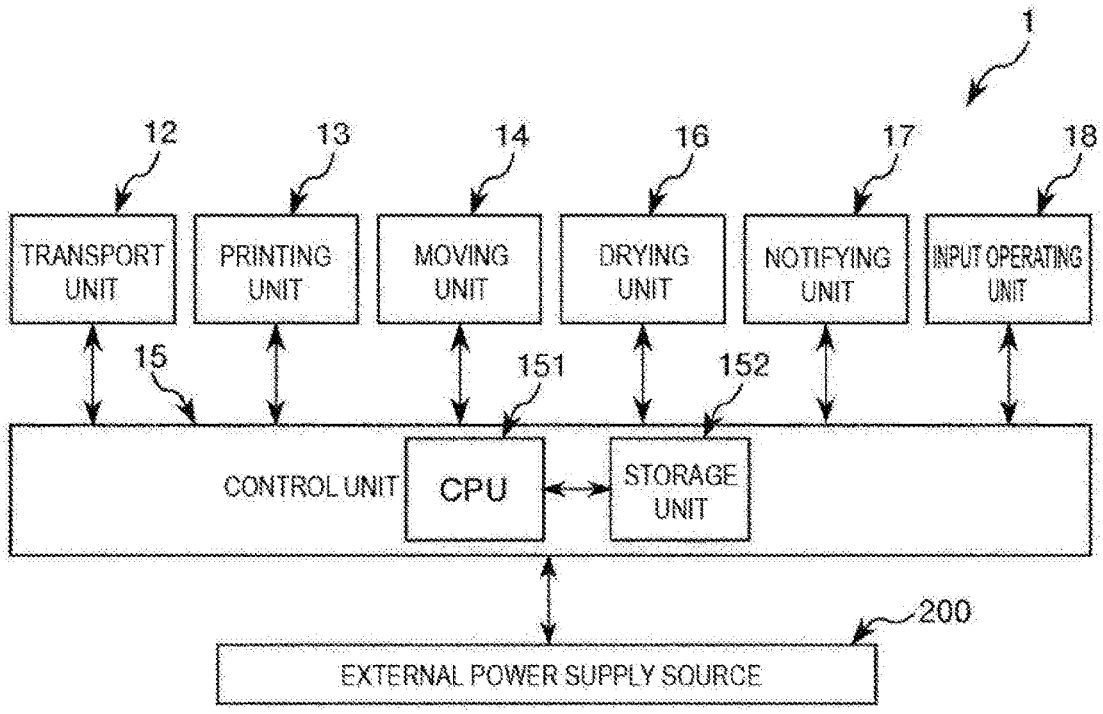
FIG. 2 is a block diagram illustrating primary elements of the printing apparatus illustrated in FIG. 1.
Figure 3:
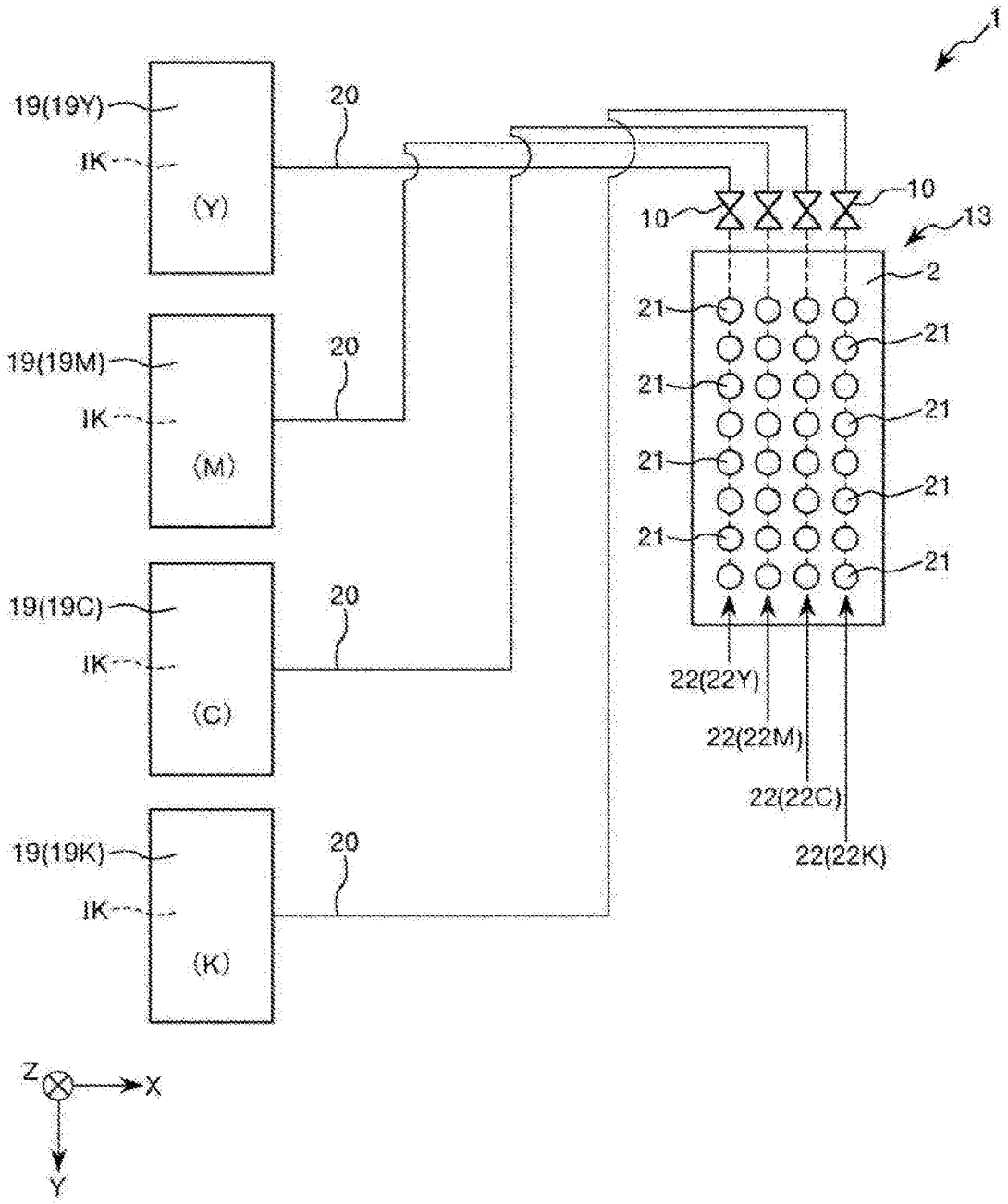
FIG. 3 is a diagram illustrating a relationship between an ink jet head and ink cartridges in the printing apparatus illustrated in FIG. 1.
Figure 4:
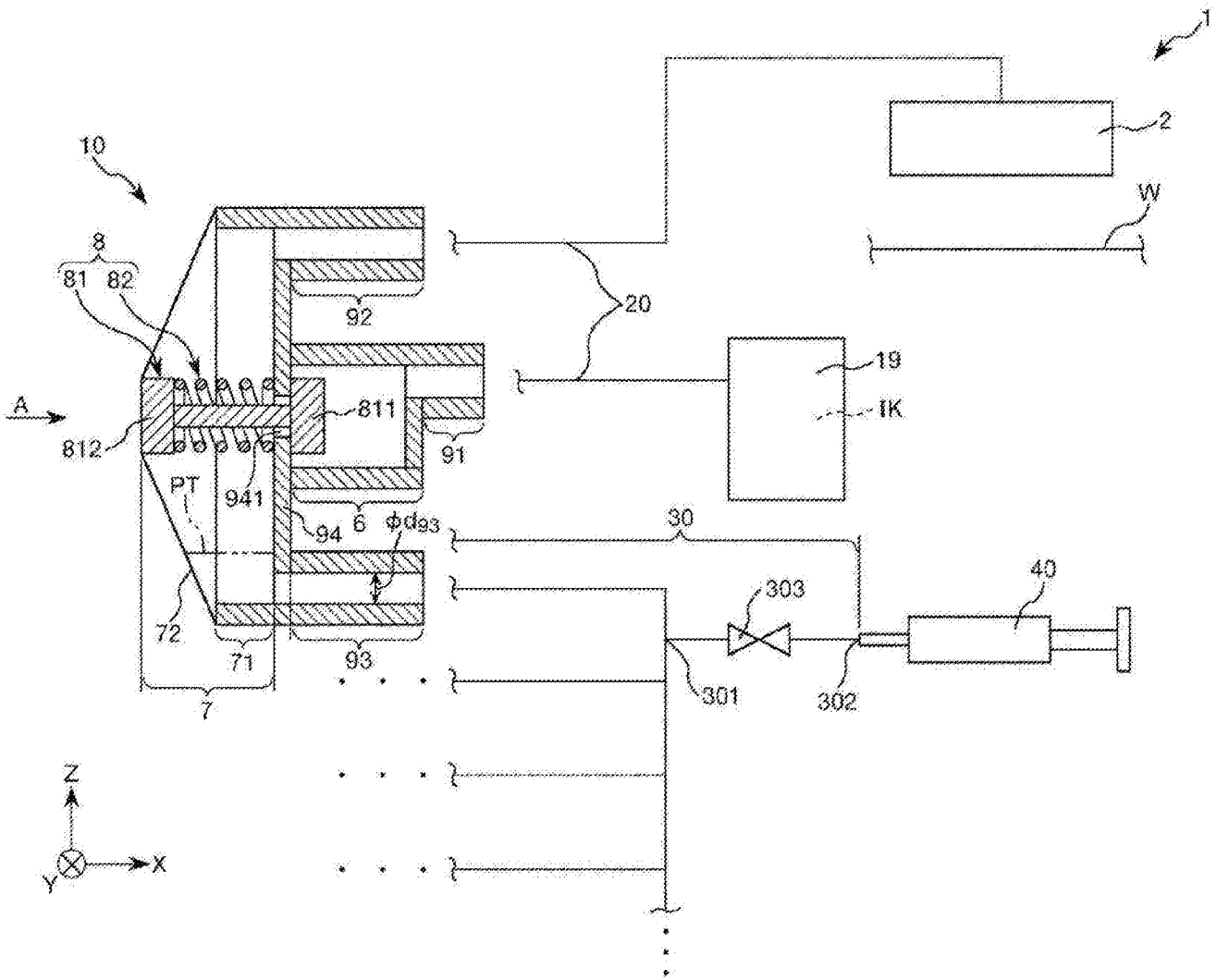
FIG. 4 is a schematic cross-sectional view illustrating an operating state of a valve unit according to the invention, which is included in the printing apparatus illustrated in FIG. 1.
Figure 5:
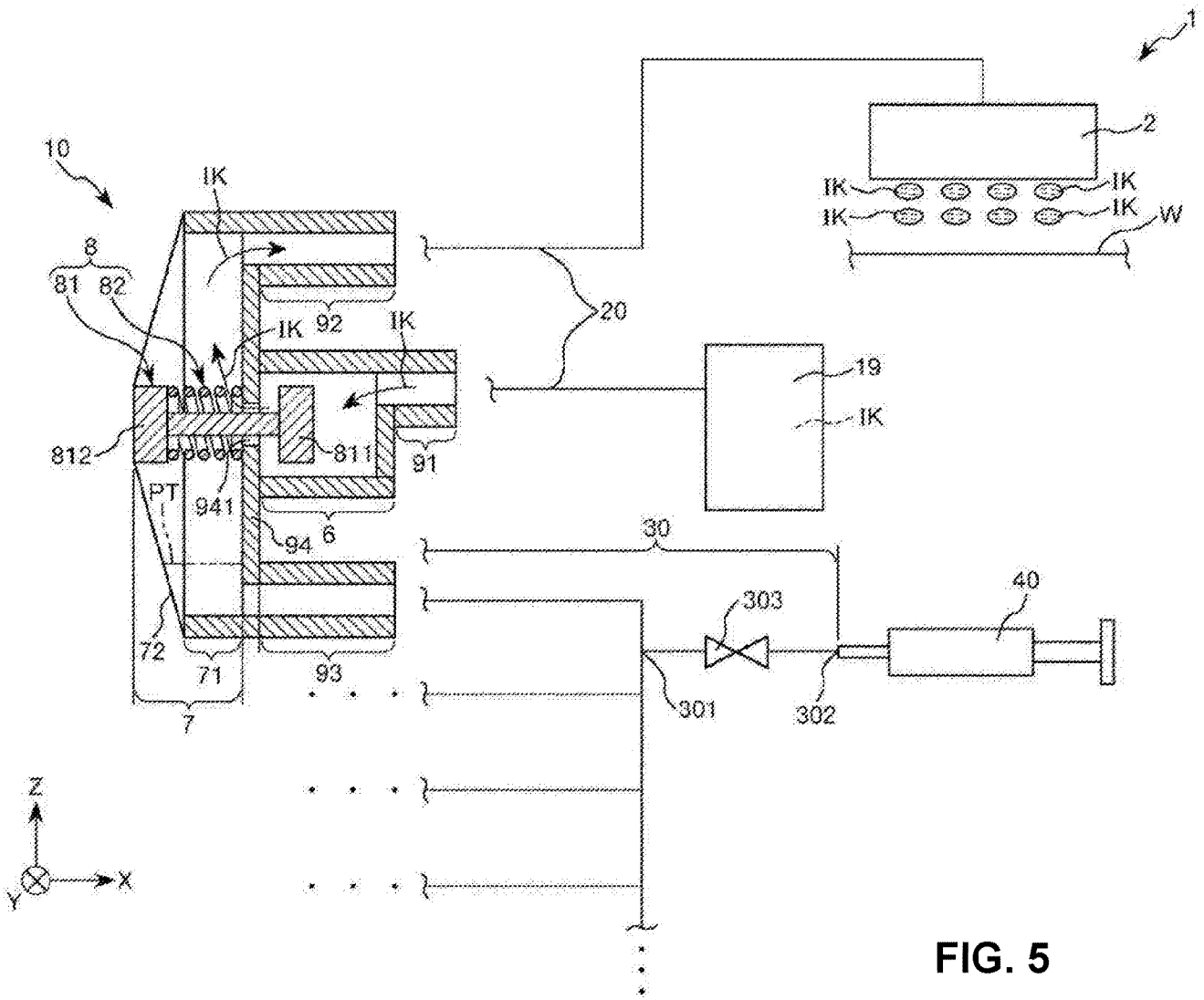
FIG. 5 is a schematic cross-sectional view illustrating an operating state of the valve unit according to the invention, which is included in the printing apparatus illustrated in FIG. 1.
Figure 6:
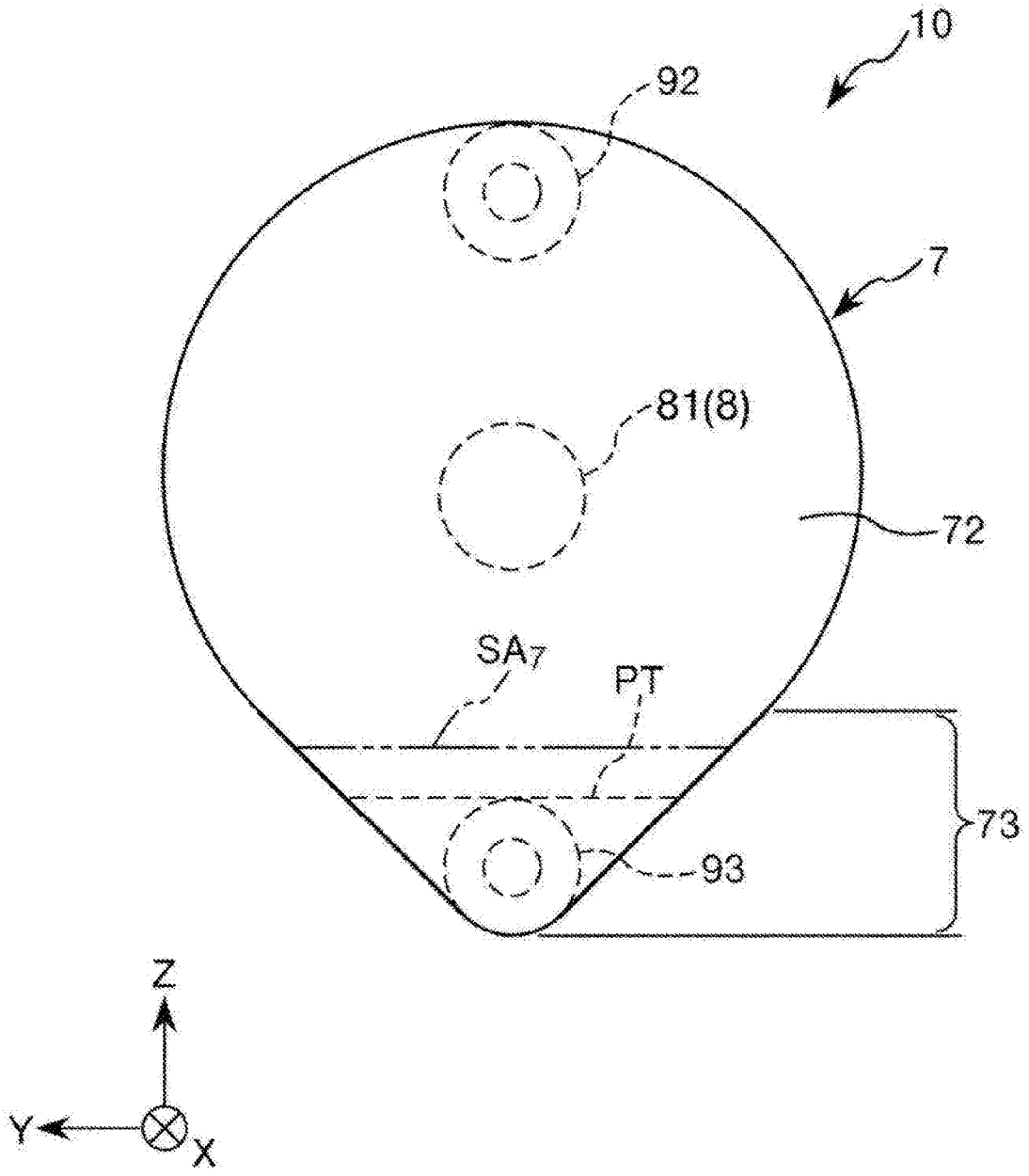
FIG. 6 is a diagram seen from the direction of arrow A in FIG. 4.
Figure 7:
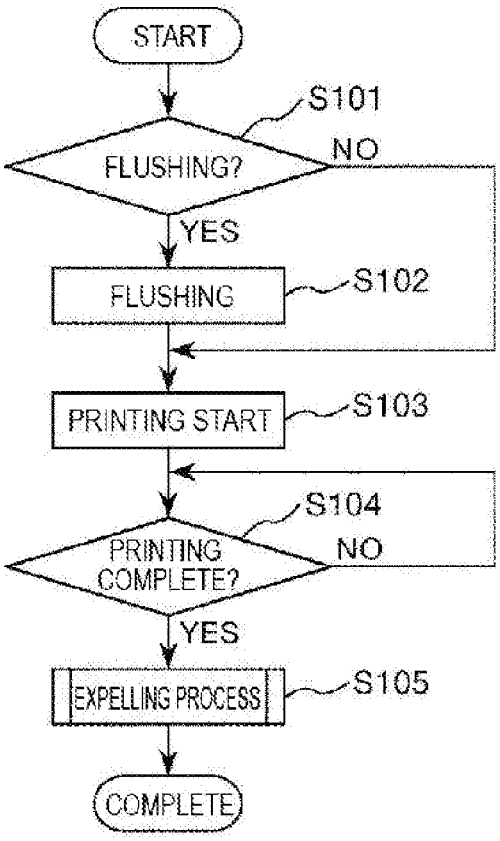
FIG. 7 is a flowchart illustrating a control program stored in the printing apparatus illustrated in FIG. 1.
Figure 8:
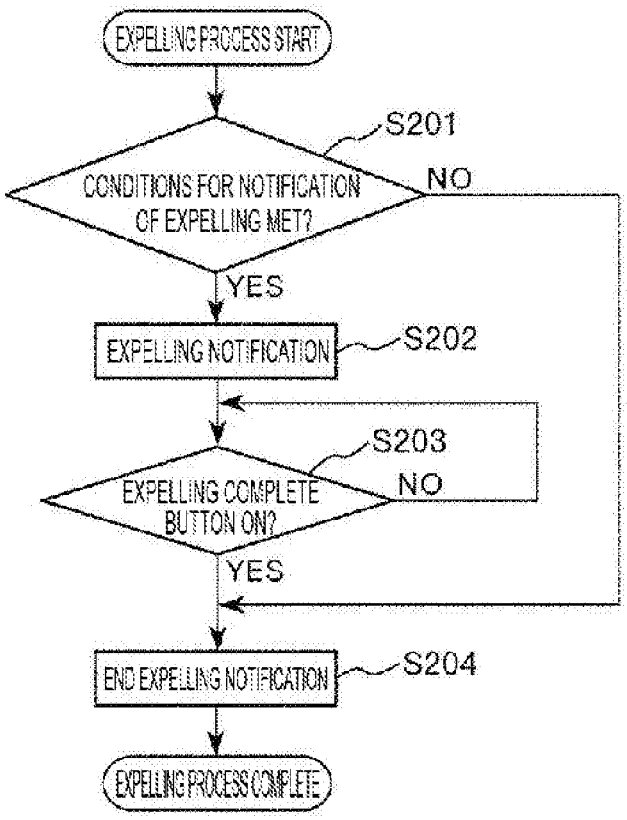
FIG. 8 is a flowchart illustrating an expelling process that is a subroutine of the flowchart illustrated in FIG. 7.

FIG. 1 is a schematic side view illustrating a first exemplary embodiment of the printing apparatus according to the invention. FIG. 2 is a block diagram illustrating primary elements of the printing apparatus illustrated in FIG. 1. FIG. 3 is a diagram illustrating a relationship between an ink jet head and ink cartridges in the printing apparatus illustrated in FIG. 1. FIG. 4 and FIG. 5 are schematic cross-sectional views illustrating an operating state of the valve unit according to the invention, which is included in the printing apparatus illustrated in FIG. 1. FIG. 6 is a diagram seen from the direction of arrow A in FIG. 4. FIG. 7 is a flowchart illustrating a control program stored in the printing apparatus illustrated in FIG. 1. FIG. 8 is a flowchart illustrating an expelling process that is a subroutine of the flowchart illustrated in FIG. 7. For the purposes of these descriptions, in the following, a paper depth direction, a left-right direction, and an up-down direction in FIG. 1 will be referred to as an "X direction", a "Y direction", and a "Z direction", respectively. The coordinate axes indicated in FIG. 3 to FIG. 6, FIG. 9, and FIG. 10 also correspond to the coordinate axes indicated in FIG. 1.

A printing apparatus 1 according to the invention is an apparatus that includes: ink cartridges 19 serving as reservoir units that hold ink IK; an ink jet head 2 serving as a discharge unit configured to discharge the ink IK; flow channels 20, each connecting one of the ink cartridges 19 (reservoir units) to the ink jet head 2 (discharge unit), through which the ink IK passes from the ink cartridge 19 (reservoir unit) toward the ink jet head 2 (discharge unit); and valve units 10 according to the invention, which are disposed partway along the flow channels 20.

Meanwhile, a printing method according to the invention includes printing onto a recording medium using the printing apparatus 1, and expelling sediment from an expelling unit when the printing is stopped.

The valve unit 10, meanwhile, includes: a first chamber 6 configured to communicate with the ink cartridge 19 (reservoir unit); a second chamber 7 configured to communicate with the ink jet head 2 (discharge unit); a switching valve 8 that switches between allowing and cutting off the flow of the ink IK from the first chamber 6 to the second chamber 7; and a sediment expelling section (expelling unit) 93 that expels sediment PT within the second chamber 7 by suctioning the sediment PT.

The printing method according to the invention also includes printing onto a workpiece W, the workpiece W being a recording medium, using the printing apparatus 1, and expelling the sediment PT from the sediment expelling section (expelling unit) 93 of the valve unit 10 in the printing apparatus 1 when the printing is stopped.

According to the invention, even if sediment PT is formed in the second chamber 7 of the valve unit 10, that sediment PT can be expelled by the sediment expelling section 93, as will be described later. Doing so makes it possible to prevent the sediment PT from flowing out toward the ink jet head 2. This in turn makes it possible to reduce or prevent clogging, discharge defects, and the like from occurring in the ink jet head 2.

Next, configurations of the respective units will be described. The printing apparatus 1 is a printing apparatus that prints onto a workpiece W, the workpiece W being a recording medium, while transporting the workpiece W.

As illustrated in FIG. 1, the printing apparatus 1 includes: a machine base 11; a transport unit 12 that transports the workpiece W; a printing unit 13 that prints by applying the ink IK onto the workpiece W; a drying unit 16 that dries the ink IK on the workpiece W; and a control unit 15 that controls the operations of these units. Additionally, as illustrated in FIG. 2, the printing apparatus 1 includes: a moving unit 14 that moves the printing unit 13; a notifying unit 17 that makes notifications of various types of information; and an input operation unit 18 through which various conditions used during printing are input and set. In the printing apparatus 1, the control unit 15 is electrically connected to an external power supply source 200.

In the present exemplary embodiment, a direction orthogonal to a transport direction in which the workpiece W is transported corresponds to the X direction, a direction parallel to the transport direction corresponds to the Y direction, and a direction orthogonal to both the X direction and the Y direction corresponds to the Z direction.

The transport unit 12 includes: an unwinding device 3 that unwinds the workpiece W, which has a long length and is wound into a roll; a winding device 4 that winds up the printed workpiece W; and a support device 5, arranged upon the machine base 11, that supports the workpiece W during printing.

The unwinding device 3 is arranged on the upstream side of the machine base 11 in the transport direction of the workpiece W (the Y direction). The unwinding device 3 has a feed-out roller (feed-out reel) 31 on which the workpiece W is wound into a roll and that feeds out the workpiece W, and a tensioner 32 that applies tension to the workpiece W between the unwinding device 3 and the support device 5. The feed-out roller 31 is connected to a motor (not illustrated), and can rotate in response to the motor operating.

A material to be printed can be used as the workpiece W. "Material to be printed" refers to fabric, garments, and other accessory products that are to be printed onto. "Fabric" includes woven fabrics, knitted fabrics, and nonwoven fabrics of natural fibers such as cotton, silk, and wool, synthetic fibers such as nylon, and composite fibers containing a mix thereof. "Garments and other accessory products" include fabricated t-shirts, handkerchiefs, scarves, towels, handbags, cloth bags, and furnishings such as curtains, sheets, and bed covers, as well as pre-fabrication fabric, in cut or uncut states, used as parts.

In addition to the above-described materials to be printed, standard paper, pure paper, dedicated ink jet recording paper such as glossy paper, and the like can also be used as the workpiece W. Furthermore, material not subjected to a surface treatment for ink jet printing, or in other words, on which an ink absorption layer is not formed, such as plastic film, a base material such as paper coated with plastic or to which a plastic film has been affixed, or the like can also be used as the workpiece W. This plastic is not particularly limited, and polyvinyl chloride, polyethylene terephthalate, polycarbonate, polystyrene, polyurethane, polyethylene, and polypropylene can be given as examples thereof.

The winding device 4 is arranged on the downstream side of the machine base 11 in the transport direction of the workpiece W (the Y direction), relative to the unwinding device 3. The winding device 4 has a winding roller (winding reel) 41 that winds up the workpiece W into a roll, as well as a tensioner 42, a tensioner 43, and a tensioner 44 that apply tension to the workpiece W between the winding roller 41 and the support device 5. The winding roller 41 is connected to a motor (not illustrated), and can rotate in response to the motor operating. The tensioner 42 to the tensioner 44 are arranged in that order at intervals moving away from the winding roller 41.

The support device 5 is disposed between the unwinding device 3 and the winding device 4. The support device 5 includes: a driving roller 51 and a driven roller 52 disposed at a distance from each other in the Y direction; an endless belt 53 wrapped upon the driving roller 51 and the driven roller 52; and a tensioner 54 and a tensioner 55 that apply tension to the workpiece W between the driving roller 51 and the driven roller 52.

The driving roller 51 is connected to a motor (not illustrated), and can rotate in response to the motor operating. Rotational force of the driving roller 51 is transmitted to the driven roller 52 by the endless belt 53, and as a result, the driven roller 52 can rotate in tandem with the driving roller 51.

The endless belt 53 is a glue belt having an adhesive layer formed on front and side surfaces thereof. The workpiece W is transported in the Y direction by partially adhering to the adhesive layer. The workpiece W is printed onto during this transport. The workpiece W is then separated from the endless belt 53 after the printing is complete.

Like the driving roller 51 and the driven roller 52, the tensioner 54 and the tensioner 55 are disposed at a distance from each other in the Y direction.

The tensioner 54 can press the workpiece W and the endless belt 53 together against the driving roller 51, and the tensioner 55 can press the workpiece W and the endless belt 53 against the driven roller 52. As a result, the workpiece W to which tension is applied by the tensioner 54 and the tensioner 55 can be fixed to the endless belt 53 and transported in a state where that tension is applied. This prevents the workpiece W from forming wrinkles or the like, for example, during transport. Doing so ensures that the printing carried out on the workpiece W is both accurate and of high quality.

The printing unit 13 includes a carriage unit 131. The ink jet head 2 that prints an image (records) onto the workpiece W by discharging the ink IK onto the workpiece W is mounted on the carriage unit 131.

The ink IK contains a pigment, serving as a colorant, dispersed throughout water, serving as a carrier. In the exemplary embodiment, four colors of ink, namely yellow (Y), magenta (M), cyan (C), and black (K), are used. The printing apparatus 1 is therefore capable of color printing.

As illustrated in FIG. 3, the ink jet head 2 is a discharge unit having numerous nozzles 21 that discharge the ink IK as droplets. In the ink jet head 2, the nozzles 21 are divided into nozzle rows 22 that correspond to the colors of the ink IK to be discharged therefrom. In the configuration illustrated in FIG. 3, there is a nozzle row 22Y, a nozzle row 22M, a nozzle row 22C, and a nozzle row 22K. The nozzle row 22Y is constituted of numerous nozzles 21 for discharging yellow (Y) ink IK. These nozzles 21 are disposed along the Y direction. The nozzle row 22M is constituted of numerous nozzles 21 for discharging magenta (M) ink IK. These nozzles 21 are disposed along the Y direction. The nozzle row 22C is constituted of numerous nozzles 21 for discharging cyan (C) ink IK. These nozzles 21 are disposed along the Y direction. The nozzle row 22K is constituted of numerous nozzles 21 for discharging black (K) ink IK. These nozzles 21 are disposed along the Y direction. The ink IK is discharged individually from each of the nozzles 21.

As such, the printing apparatus 1 is capable of color printing. The ink jet head 2 (discharge unit) has the nozzle rows 22, each of which is constituted of the numerous nozzles 21 that discharge the same color ink IK as droplets. Thus, the workpiece W on which color printing has been carried out has an extremely fine, or in other words, a precise color image.

As illustrated in FIG. 3, with the printing apparatus 1, the ink IK of each color is prepared in advance by and in a corresponding ink cartridge 19 serving as a reservoir unit. In the configuration illustrated in FIG. 3, an ink cartridge 19Y holding yellow (Y) ink IK, an ink cartridge 19M holding magenta (M) ink IK, an ink cartridge 19C holding cyan (C) ink IK, and an ink cartridge 19K holding black (K) ink IK are provided. When the ink IK therein is used up, each ink cartridge 19 is replaced with a new cartridge, that is, a cartridge containing a sufficient amount of ink IK. The ink cartridges 19 are affixed to the apparatus in positions distanced from the printing unit 13.

Each ink cartridge 19 is connected in a fluid-tight manner to the nozzle row 22 corresponding to that ink cartridge 19 by one of the flow channels 20. In other words, the ink cartridge 19Y and the nozzle row 22Y are connected by one of the flow channels 20, the ink cartridge 19M and the nozzle row 22M are connected by one of the flow channels 20, the ink cartridge 19C and the nozzle row 22C are connected by one of the flow channels 20, and the ink cartridge 19K and the nozzle row 22K are connected by one of the flow channels 20. As a result, the ink IK can flow from the ink cartridges 19 to the nozzle rows 22 through the flow channels 20. The flow channels 20 are constituted of, for example, tubes and connectors that connect the tubes to each other in a fluid-tight manner.

The valve unit 10 is disposed partway along each of the flow channels 20. Thus, a single valve unit 10 is disposed for a single corresponding nozzle row 22. The valve unit 10 is what is called a "self-sealing valve" for stabilizing the pressure at which the ink IK is supplied to the ink jet head 2. Thus, the ink IK can be stably discharged as droplets from the nozzles 21 belonging to each nozzle row 22.

The configuration of the valve unit 10 will be described later.

According to the printing apparatus 1, the workpiece W unwound by the unwinding device 3 is intermittently transported in the Y direction (sub scanning) in a fixed state of adhering to the endless belt 53, and the ink IK is discharged from the ink jet head 2 onto the fixed workpiece W while the carriage unit 131 is moved back and forth in the X direction (main scanning) by the moving unit 14. This can be carried out until the printing is complete and an image is formed on the workpiece W.

The moving unit 14 supports the printing unit 13 so as to be mobile in the X direction. Accordingly, the printing unit 13 can move back and forth so as to pass across the workpiece W. For example, a unit having a ball screw and a linear guide is desirable as the unit that constitutes the moving unit 14.

The drying unit 16 is disposed downstream from the printing unit 13 in the transport direction of the workpiece W, between the support device 5 and the winding roller 41 of the winding device 4. The drying unit 16 includes a chamber 161 in which a heater is installed. As a result, ink IK that is still wet on the workpiece W can be dried by heat from the heater as the workpiece W passes through the chamber 161.

The tensioner 42 and the tensioner 43 are provided on respective sides of the drying unit 16 in the Y direction. As a result, the workpiece W can pass through the chamber 161 in a state in which tension is applied to the workpiece W. This prevents the workpiece W from forming wrinkles or the like, for example, while passing through the chamber 161. Doing so ensures that the ink IK is dried reliably.

The notifying unit 17 is constituted of a speaker and/or a signal lamp, for example. The printing apparatus 1 can therefore communicate various types of information through sounds, lights, or the like.

The input operation unit 18 is constituted of a touch panel, for example. An operator of the printing apparatus 1 can input various conditions used during printing through the input operation unit 18. These conditions are not particularly limited, and a printing program, a transport speed and thickness of the workpiece W, and the like can be given as examples thereof. Note that the input operation unit 18 can also function as the notifying unit 17 by displaying various types of information of the printing apparatus 1 as notifications.

The control unit 15 is electrically connected to the transport unit 12, the printing unit 13, the moving unit 14, the drying unit 16, the notifying unit 17, and the input operation unit 18, and has a function for controlling these operations. As illustrated in FIG. 2, the control unit 15 includes a central processing unit (CPU) 151 and a storage unit 152.

The CPU 151 executes programs for various processes such as the printing process described earlier.

The storage unit 152 includes, for example, an Electrically Erasable Programmable Read-Only Memory (EEPROM), which is an example of a non-volatile semiconductor memory, and can store various types of programs and the like.

The external power supply source 200, which applies a 200 V voltage, for example, is electrically connected to the control unit 15. Power is supplied to the various units of the printing apparatus 1 as a result.

As described earlier, a said valve unit 10 is disposed partway along each of the flow channels 20 (see FIG. 3). As illustrated in FIG. 4 and FIG. 5, the valve unit 10 includes the first chamber 6, the second chamber 7, the switching valve 8, an ink inflow section 91, an ink outflow section 92, and the sediment expelling section (expelling unit) 93.

The first chamber 6 has a ring shape, and is constituted of a hard resin material, for example. The first chamber 6 communicates with the ink cartridge 19 through the ink inflow section 91. Accordingly, the ink IK from the ink cartridge 19 can flow into the first chamber 6 through the ink inflow section 91.

The ink inflow section 91 is an ink inflow port formed in a pipe shape projecting from the first chamber 6, and is connected in a fluid-tight manner to the ink cartridge 19 side of the flow channel 20, partway along that flow channel 20.

The second chamber 7 is disposed adjacent to the first chamber 6 so as to be concentric with the first chamber 6. The second chamber 7 has a ring shape that is larger than the first chamber 6, and includes a hard portion 71 constituted of a hard resin material, for example, and a film 72 that covers the hard portions 71 from the side opposite from the first chamber 6. A through hole 941 is formed in a wall portion 94 that separates the first chamber 6 and the second chamber 7. Accordingly, the ink IK can pass from the first chamber 6 to the second chamber 7 through the through hole 941.

The second chamber 7 communicates with the ink jet head 2 through the ink outflow section 92. Accordingly, the ink IK within the second chamber 7 can flow out toward the ink jet head 2 through the ink outflow section 92.

Similar to the ink inflow section 91, the ink outflow section 92 is an ink outflow port formed in a pipe shape projecting from the second chamber 7, and is connected in a fluid-tight manner to the ink jet head 2 side of the flow channel 20, partway along that flow channel 20.

The switching valve 8 switches between allowing and cutting off the flow of the ink IK from the first chamber 6 to the second chamber 7 by opening and closing the through hole 941. The switching valve 8 includes a valve body 81 and a coil spring 82.

The valve body 81 is shaped as a rod inserted into the through hole 941. An enlarged diameter portion 811 and an enlarged diameter portion 812 are provided on opposite ends of the valve body 81. The enlarged diameter portion 811 is positioned within the first chamber 6, and can cover the through hole 941 to achieve a closed state (closed). The enlarged diameter portion 812 is positioned within the second chamber 7, and is bonded to a central part of the film 72. It is desirable that the valve body 81 be constituted of an elastic material such as rubber.

The coil spring 82, serving as a biasing member that biases the valve body 81, is disposed between the enlarged diameter portion 812 and the wall portion 94 in a compressed state. As a result, the through hole 941 can be covered by the enlarged diameter portion 811 and put into the closed state reliably. This makes it possible to block the ink IK from passing (see FIG. 4). Additionally, the second chamber 7 is gradually depressurized when an operation for discharging the ink IK is carried out in the ink jet head 2 in this closed state. As a result, the film 72 pressurizes the coil spring 82 through the enlarged diameter portion 812, against the biasing force of the coil spring 82. Due to this pressurization, the enlarged diameter portion 811 separates from the through hole 941, causing the through hole 941 to enter an open state (open) and enable the ink IK to pass (see FIG. 5).

Incidentally, in recent years, there have seen an increasing trend toward deeper colors in the ink IK. Thus, the ink IK contains a comparatively high percentage of low-solubility components such as pigment. Some of these low-solubility components are compressed between the enlarged diameter portion 811 and the wall portion 94 by the operation of the switching valve 8, and form clumps. In some cases, these clumps sink down from the enlarged diameter portion 811 or the wall portion 94, flow into the second chamber 7 along with the ink IK, and exist as sediment PT within the second chamber 7. In this case, the sediment PT can be pushed out from the second chamber 7 along with the ink IK as the pressure within the second chamber 7 changes, and may act as a foreign substance that produces clogging, discharge defects, or the like in the ink jet head 2.

Accordingly, the printing apparatus 1 is configured to prevent such problems. This configuration will be described next.

As illustrated in FIG. 4 and FIG. 5, the valve unit 10 includes the sediment expelling section 93 that, in the case where sediment PT is formed in the second chamber 7, expels the sediment PT by suctioning the sediment PT. The sediment expelling section 93 is a sediment expelling port formed in a pipe shape projecting from the second chamber 7 in the same direction as the ink outflow section 92. The sediment expelling section 93 is connected to an expelling flow channel 30 in a fluid-tight manner. The sediment PT can be reliably expelled from the second chamber 7 as a result.

The sediment expelling section 93 is disposed on the opposite side to the ink outflow section 92 relative to the first chamber 6. The valve unit 10 is used while oriented such that the ink outflow section 92 is positioned above the second chamber 7 and the sediment expelling section (expelling unit) 93 is positioned below the second chamber 7. The sediment PT settles downward in the second chamber 7, and thus positioning the sediment expelling section 93 below the second chamber 7 ensures that the sediment PT is quickly expelled from the sediment expelling section 93.

The amount of sediment PT expelled through the sediment expelling section (expelling unit) 93 is set to be less than the amount of ink IK supplied from the second chamber 7 to the ink jet head 2 (discharge unit) through the ink outflow section 92. Although ink IK is expelled from the sediment expelling section 93 along with the sediment PT, the amount of ink IK expelled can be suppressed to the greatest extent possible. This makes it possible to prevent the ink IK from being wastefully expelled.

Although also dependent on the size of the grains that constitute the sediment PT, it is desirable that an inner diameter (093 of the sediment expelling section 93 be from 1 mm to 5 mm, and further desirable that the inner diameter (093 be from 1 mm to 2 mm. This prevents the sediment PT from clogging partway along the sediment expelling section 93 and makes it possible to smoothly expel the sediment PT.

As illustrated in FIG. 6, the second chamber 7 includes a cross-sectional area decreasing section (part) 73, provided below the second chamber 7, in which a horizontal cross-sectional area $SA_7$ decreases toward the sediment expelling section (expelling unit) 93 side. This ensures that the sediment PT gathers toward the sediment expelling section 93. Doing so makes it easy to expel the sediment PT from the sediment expelling section 93.

As described earlier, the ink jet head 2 (discharge unit) has a plurality of nozzle rows 22. A single valve unit 10 is disposed for each corresponding nozzle row 22. As illustrated in FIG. 4 and FIG. 5, in the printing apparatus 1, the expelling flow channel 30 connected to each valve unit 10 includes a merging portion 301 and a connecting portion 302 provided downstream from the merging portion 301. The merging portion 301 is a part into which the sediment PT expelled through the sediment expelling section (expelling unit) 93 of the valve unit 10 merges. The connecting portion 302 is a part to which is connected a syringe 40 serving as a suction device that suctions the sediment PT expelled through the sediment expelling section (expelling unit) 93. By including the merging portion 301 and the connecting portion 302, the sediment PT that has flowed in through the merging portion 301 can be suctioned and expelled at once by operating the syringe 40. The operation for expelling the sediment PT can therefore be carried out quickly.

Additionally, an opening/closing valve 303 is provided between the merging portion 301 and the connecting portion 302. The opening/closing valve 303 is in an open state (open) when the sediment PT is suctioned by the syringe 40 serving as the suction device, and is in a closed state (closed) when the suctioning of the sediment PT is stopped. Accordingly, even if the syringe 40 is separated from the connecting portion 302, for example, setting the opening/closing valve 303 to the closed state makes it possible to prevent bubbles from entering into the valve unit 10 from the exterior. Although not particularly limited, it is desirable that a manual-type valve that is opened and closed manually be used as the opening/closing valve 303.

As described earlier, the notifying unit 17 is a unit that makes notifications of various types of information for the printing apparatus 1. The various types of information include "prompting an operator or the like to expel sediment PT". Accordingly, the notifying unit 17 can make a notification that prompts an operator or the like to expel the sediment PT, as one of the various types of information for the printing apparatus 1. Thus, an operator operating the printing apparatus 1, a worker maintaining the printing apparatus 1, or the like can carry out the operation for expelling the sediment PT without forgetting.

According to the configuration described above, even if sediment PT is formed in the second chamber 7 of the valve unit 10, that sediment PT can be expelled through the sediment expelling section 93. Doing so makes it possible to reduce or prevent the sediment PT from flowing out toward the ink jet head 2. This in turn makes it possible to reduce or prevent clogging, discharge defects, and the like from occurring in the ink jet head 2.

Next, the timing at which the operation for expelling sediment PT after the printing apparatus 1 starts operating will be described with reference to the flowcharts in FIG. 7 and FIG. 8.

Upon it being determined that flushing, in which the ink jet head 2 makes a trial discharge of the ink IK, is to be carried out (step S101), the flushing is carried out (step S102).

Next, printing is started (step S103). Then, upon it being determined that printing has ended (step S104), the expelling process for expelling sediment PT is carried out (step S105). In the exemplary embodiment, step S103 to step S104 correspond to printing, and step S105 corresponds to expelling.

In the expelling process, first, it is determined whether or not a condition for notifying an operator or the like that "the sediment PT should be expelled has been met" (step S201). The conditions listed below in Table 1 can be given as examples of the conditions for making the notification, and these can be selected as appropriate by the user of the printing apparatus 1. In the printing apparatus 1, sediment PT is considered to have accumulated in the valve unit 10 when one, any two or all the conditions listed in Table 1 are met depending on how the printer is set up. This is verified in advance experimentally.

TABLE 1

| | Notification Condition |
|---|---|
| Condition 1 | Number of times switching valve 8 in valve unit 10 has operated, that is, number of times valve has opened/closed has reached predetermined number |
| Condition 2 | Total amount of ink IK discharged for each type of ink IK has reached predetermined amount |
| Condition 3 | Total time ink IK discharged for each type of ink IK has reached predetermined time |

Next, upon it being determined in step S201 that the condition for making the notification is met, a notification that "the sediment PT should be expelled is made" (step S202). The operator, for example, who has heard the notification can then set the opening/closing valve 303 to the open state and operate the syringe 40. The operation of expelling the sediment PT is carried out as a result. After the expelling operation is complete, the operator presses a button (not illustrated) indicating the expelling operation is complete. This button is disposed in the input operation unit 18, for example.

Next, once it has been determined that the button has been pressed, the notification that "the sediment PT should be expelled is ended" (step S204).

Thus, according to the exemplary embodiment, the sediment PT is expelled through the sediment expelling section (expelling unit) 93 after the discharge of ink IK from the ink jet head 2 (discharge unit) stops and the printing is complete. Accordingly, a situation where the expelling operation affects the amount of ink IK discharged during printing, the pressure at which the ink IK is supplied to the ink jet head 2, and the like can be prevented.

Second Exemplary Embodiment

Figure 9:
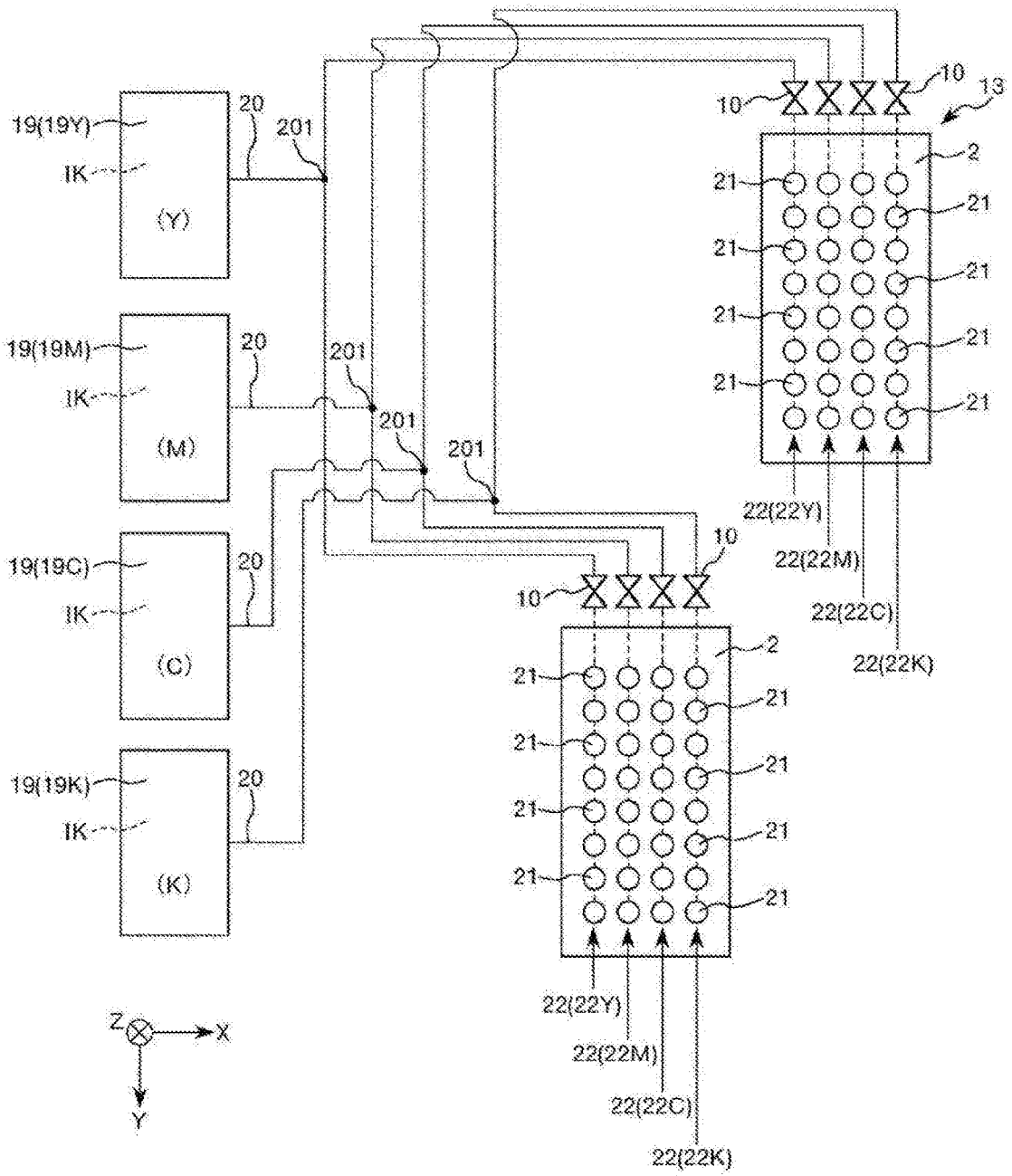
FIG. 9 is a diagram illustrating a relationship between an ink jet head and ink cartridges in a printing apparatus according to the invention (second exemplary embodiment).

FIG. 9 is a diagram illustrating a relationship between an ink jet head and ink cartridges in a printing apparatus according to the invention (second exemplary embodiment).

The second exemplary embodiment of the valve unit, the printing apparatus, and the printing method according to the invention will be described hereinafter with reference to the drawings. The descriptions, however, will focus on the differences from the above-described exemplary embodiment, and items that are the same will not be described.

The present exemplary embodiment is the same as the above-described first exemplary embodiment, with the exception of the number of ink jet heads provided.

As illustrated in FIG. 9, in the exemplary embodiment, a plurality of ink jet heads 2 (two, in the illustrated configuration) are provided.

The flow channel 20 connected to the ink cartridge 19Y branches midway into a plurality of branches at a branching portion 201, and is connected to the nozzle row 22Y in each ink jet head 2.

Likewise, the flow channel 20 connected to the ink cartridge 19M branches midway into a plurality of branches at a branching portion 201, and is connected to the nozzle row 22M in each ink jet head 2.

The flow channel 20 connected to the ink cartridge 19C branches midway into a plurality of branches at a branching portion 201, and is connected to the nozzle row 22C in each ink jet head 2.

The flow channel 20 connected to the ink cartridge 19K branches midway into a plurality of branches at a branching portion 201, and is connected to the nozzle row 22K in each ink jet head 2.

According to this configuration, ink IK can be supplied to nozzle rows 22 of the same color in a plurality of ink jet heads 2, from a single ink cartridge 19. Preferably, a valve unit 10 is supplied for each branch of each flow channel 20.

Third Exemplary Embodiment

Figure 10:
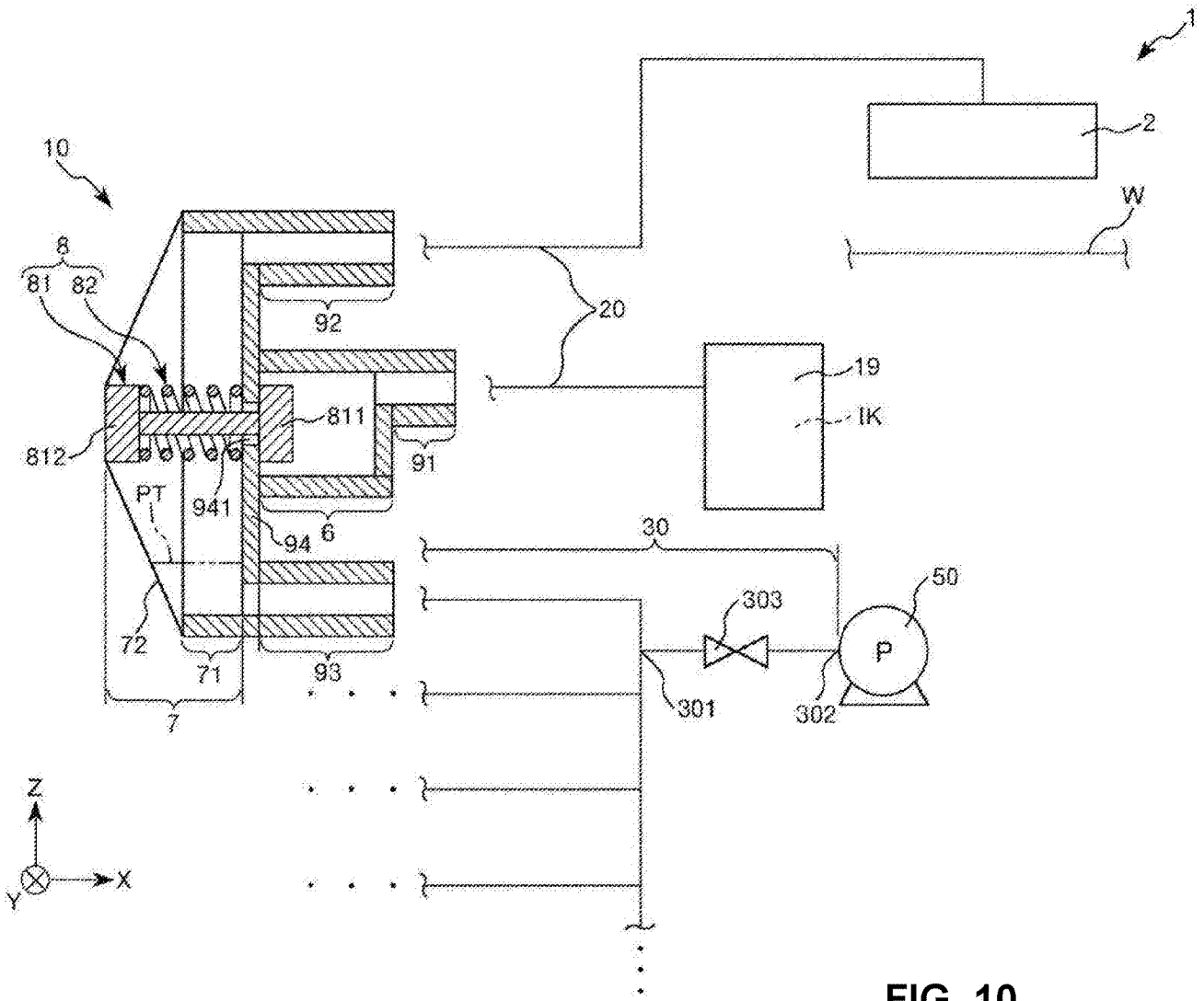
FIG. 10 is a schematic cross-sectional view illustrating a valve unit according to the invention, which is included in a printing apparatus according to the invention (third exemplary embodiment).

FIG. 10 is a schematic cross-sectional view illustrating a valve unit according to the invention, which is included in a printing apparatus according to the invention (third exemplary embodiment).

The third exemplary embodiment of the valve unit, the printing apparatus, and the printing method according to the invention will be described hereinafter with reference to the drawings. The descriptions, however, will focus on the differences from the above-described exemplary embodiments, and items that are the same will not be described.

The present exemplary embodiment is the same as the above-described first exemplary embodiment, with the exception of the configuration of the suction device that suctions the sediment.

As illustrated in FIG. 10, in the exemplary embodiment, a pump 50 is used as the suction device that suctions the sediment PT. The operation for expelling the sediment PT can therefore be carried out easily. Although not particularly limited, it is desirable that a gear pump, a vane pump, or the like be used as the pump 50.

Fourth Exemplary Embodiment

Figure 11:
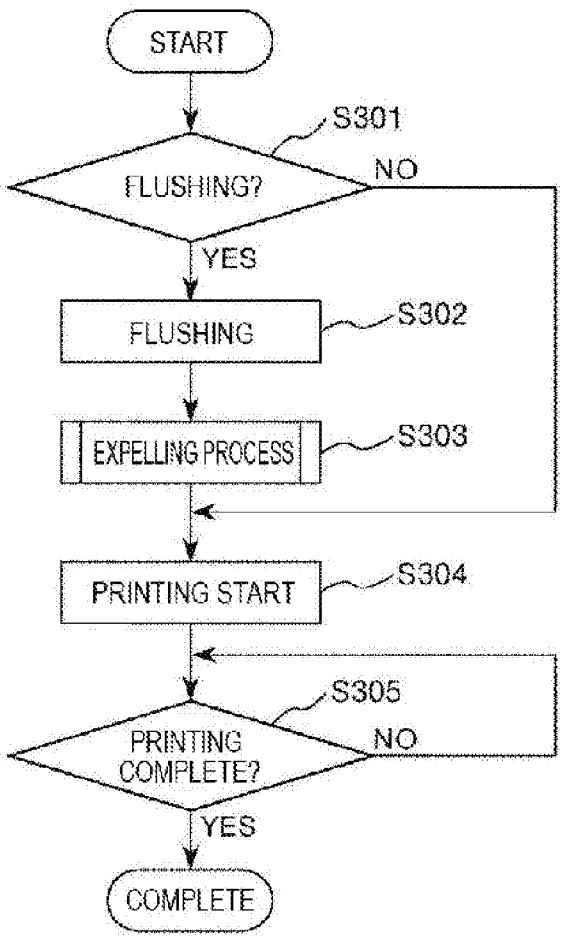
FIG. 11 is a flowchart illustrating a control program stored in a printing apparatus according to the invention (fourth exemplary embodiment).

FIG. 11 is a flowchart illustrating a control program stored in a printing apparatus according to the invention (fourth exemplary embodiment).

The fourth exemplary embodiment of the valve unit, the printing apparatus, and the printing method according to the invention will be described hereinafter with reference to the drawings. The descriptions, however, will focus on the differences from the above-described exemplary embodiments, and items that are the same will not be described.

The present exemplary embodiment is the same as the above-described first exemplary embodiment, with the exception of the timing at which the expelling process is executed.

As illustrated in FIG. 11, in the exemplary embodiment, upon it being determined that flushing, in which the ink jet head 2 makes a trial discharge of the ink IK, is to be carried out (step S301), the flushing is carried out (step S302).

Next, the expelling process for expelling sediment PT is carried out (step S303). In the exemplary embodiment, step S303 corresponds to expelling, and the steps S201 to S204 are executed in order.

Next, printing is started (step S304). It is then determined whether or not the printing is complete (step S305). In the exemplary embodiment, step S304 to step S305 correspond to printing.

Thus, according to the exemplary embodiment, the sediment PT is expelled through the sediment expelling section (expelling unit) 93 after the flushing that makes a trial discharge of the ink IK from the ink jet head 2 (discharge unit), but before printing starts. Accordingly, a situation where the expelling operation affects the amount of ink IK discharged during printing, the pressure at which the ink IK is supplied to the ink jet head 2, and the like can be prevented. The expelling of sediment PT may be carried out at the same time as or before the flushing.

The valve unit, the printing apparatus, and the printing method according to the invention have been described thus far with reference to the illustrated exemplary embodiments, but the invention is not intended to be limited thereto. The units constituting the valve unit and the printing apparatus can be replaced with any configurations capable of achieving the same functions. Any desired configurations may be added as well.

Additionally, the valve unit, the printing apparatus, and the printing method according to the invention may be realized by combining two or more desired configurations (features) of the above-described exemplary embodiments.

Although the exemplary embodiments describe four colors of ink as being used in the printing apparatus, the number of colors is not limited thereto. For example, eight colors or the like may be used.

Additionally, although the transport unit is described as having an endless belt to which the workpiece adheres, the transport unit is not limited thereto. For example, the transport unit may have a platen (a stage) that affixes the workpiece through suction.

This application claims priority under 35 U.S.C § 119 to Japanese Patent Application NO. 2016-129609, filed Jun. 30, 2016. The entire disclosure of Japanese Patent Application No. 2016-129609 is hereby incorporated herein by reference.

What is claimed is:

1. A valve unit, used in a printing apparatus including a reservoir unit that holds ink, a discharge unit configured to discharge the ink, and a flow channel that connects the reservoir unit to the discharge unit and through which the ink flows from the reservoir unit to the discharge unit, the valve unit being disposed in the flow channel, the valve unit comprising:

a first chamber configured to communicate with the reservoir unit;

a second chamber configured to communicate with the discharge unit;

a switching valve configured to switch between allowing and cutting off a flow of ink from the first chamber to the second chamber; and an expelling unit configured to expel sediment from the second chamber by suctioning the sediment.

2. The valve unit according to claim 1, wherein the valve unit is oriented such that the expelling unit is positioned below the second chamber.

3. The valve unit according to claim 2, wherein the second chamber has a part in which a horizontal cross-sectional area decreases toward the expelling unit side.

4. A printing apparatus comprising a reservoir unit that holds ink, a discharge unit configured to discharge the ink, a flow channel that connects the reservoir unit to the discharge unit and through which the ink flows from the reservoir unit to the discharge unit, and a valve unit disposed in the flow channel, wherein the valve unit includes:

a first chamber configured to communicate with the reservoir unit;

a second chamber configured to communicate with the discharge unit;

a switching valve configured to switch between allowing and cutting off a flow of ink from the first chamber to the second chamber; and an expelling unit configured to expel sediment from the second chamber by suctioning the sediment.

5. The printing apparatus according to claim 4, wherein the expelling of the sediment from the expelling unit is carried out when the discharge of ink from the discharge unit stops and printing ends.

6. The printing apparatus according to claim 5, wherein the expelling of the sediment from the expelling unit is carried out along with flushing that makes a trial discharge of the ink from the discharge unit, or after the flushing but before printing starts.

7. The printing apparatus according to claim 5, wherein the printing apparatus is capable of color printing; and the discharge unit includes a nozzle row having a plurality of nozzles that discharge the ink of a same color as droplets.

8. The printing apparatus according to claim 7, further comprising a plurality of nozzle rows and a plurality of valve units, wherein one of the valve units is disposed for a single one of the nozzle rows.

9. The printing apparatus according to claim 8, wherein the discharge unit has a plurality of the nozzle rows; and the printing apparatus further comprises a merging portion into which the sediment expelled through the expelling unit of each valve unit merges.

10. The printing apparatus according to claim 4, wherein the expelling of the sediment from the expelling unit is carried out along with flushing that makes a trial discharge of the ink from the discharge unit, or after the flushing but before printing starts.

11. The printing apparatus according to claim 10, wherein the printing apparatus is capable of color printing; and the discharge unit includes a nozzle row having a plurality of nozzles that discharge the ink of a same color as droplets.

12. The printing apparatus according to claim 11, further comprising a plurality of nozzle rows and a plurality of valve units, wherein one of the valve units is disposed for a single one of the nozzle rows.

13. The printing apparatus according to claim 12, wherein the discharge unit has a plurality of the nozzle rows; and the printing apparatus further comprises a merging portion into which the sediment expelled through the expelling unit of each valve unit merges.

14. The printing apparatus according to claim 4, wherein the printing apparatus is capable of color printing; and the discharge unit includes a nozzle row having a plurality of nozzles that discharge the ink of a same color as droplets.

15. The printing apparatus according to claim 14, further comprising a plurality of nozzle rows and a plurality of valve units, wherein one of the valve units is disposed for a single one of the nozzle rows.

16. The printing apparatus according to claim 15, wherein the discharge unit has a plurality of the nozzle rows; and the printing apparatus further comprises a merging portion into which the sediment expelled through the expelling unit of each valve unit merges.

17. The printing apparatus according to claim 16, further comprising:

a connecting portion, provided downstream from the merging portion, to which a suction device that suctions the sediment expelled through the expelling unit is connected; and an opening/closing valve, provided between the merging portion and the connecting portion, configured to open when the suction device suctions the sediment and close when the suctioning of the sediment is stopped.

18. The printing apparatus according to claim 4, wherein an amount of the sediment expelled through the expelling unit is less than an amount of the ink supplied from the second chamber to the discharge unit.

19. The printing apparatus according to claim 4, further comprising:

a notifying unit configured to make a notification, wherein the notification prompts a user to expel the sediment.

20. In a printing apparatus that includes a reservoir unit that holds ink, a discharge unit configured to discharge the ink, a flow channel that connects the reservoir unit to the discharge unit and through which the ink flows from the reservoir unit to the discharge unit, and a valve unit disposed in the flow channel, wherein the valve unit includes a first chamber configured to communicate with the reservoir unit, a second chamber configured to communicate with the discharge unit, a switching valve configured to switch between allowing and cutting off a flow of ink from the first chamber to the second chamber, and an expelling unit configured to expel sediment from the second chamber by suctioning the sediment, a printing method comprising:

printing onto a recording medium using the printing apparatus; and expelling the sediment from the expelling unit while the printing is stopped.

* * * * *